US007578008B2

(12) United States Patent
Hunter et al.

(10) Patent No.: US 7,578,008 B2
(45) Date of Patent: Aug. 25, 2009

(54) GARMENT PROTECTOR AND METHOD OF USE THEREOF

(76) Inventors: Ingrid Hunter, 4255 Laurel Grove Trace, Suwanee, GA (US) 30024; Cerelyn Davis, 174 Dollar Mill Rd. SW., Atlanta, GA (US) 30331

( * ) Notice: Subject to any disclaimer, the term of this patent is extended or adjusted under 35 U.S.C. 154(b) by 376 days.

(21) Appl. No.: 11/076,834

(22) Filed: Mar. 10, 2005

(65) Prior Publication Data

US 2006/0200888 A1 Sep. 14, 2006

(51) Int. Cl.
*A42B 1/04* (2006.01)

(52) U.S. Cl. ..... 2/202; 2/174

(58) Field of Classification Search ..... 2/4, 2/424, 9, 46, 174, 202, 204, 207, 206, 171, 2/172, 200.3, 205, 173; D2/865, 875, 877, D2/878, 880, 881
See application file for complete search history.

(56) References Cited

U.S. PATENT DOCUMENTS

| | | | | | |
|---|---|---|---|---|---|
| 30,818 | A | * | 12/1860 | Drummond | 2/4 |
| 1,023,677 | A | | 4/1912 | Pass | |
| 1,897,100 | A | * | 2/1933 | Abbott | 2/174 |
| D92,236 | S | * | 5/1934 | De Pew | D5/865 |
| 1,968,697 | A | * | 7/1934 | McComb | 2/174 |
| 2,017,328 | A | | 10/1935 | Taylor | |
| 2,064,032 | A | | 12/1936 | Roberts | |
| 2,189,892 | A | * | 2/1940 | Fox | 2/4 |
| 2,295,279 | A | * | 9/1942 | Andrews | 2/174 |
| 2,295,593 | A | * | 9/1942 | Bailey | 2/46 |
| 2,353,025 | A | * | 7/1944 | Gautreux | 2/174 |
| 2,372,715 | A | | 4/1945 | Ernst | |
| 2,420,916 | A | | 5/1947 | Sorge | |
| 2,436,249 | A | * | 2/1948 | Clement | 128/201.25 |
| 2,445,487 | A | | 7/1948 | Lester et al. | |
| 2,447,561 | A | | 8/1948 | Brenner | |
| 2,484,269 | A | * | 10/1949 | Carlson | 2/174 |
| 2,507,447 | A | * | 5/1950 | La Joie Lorranie et. al. | 2/174 |
| 2,869,132 | A | * | 1/1959 | Drummond | 2/174 |
| 3,505,678 | A | * | 4/1970 | Key | 2/207 |
| 3,983,580 | A | * | 10/1976 | Zeiber | 2/174 |
| 4,236,514 | A | | 12/1980 | Moretti | |
| 4,457,027 | A | | 7/1984 | Gladstone | |
| 4,665,567 | A | | 5/1987 | Dilger | |
| 4,698,853 | A | | 10/1987 | Walton | |
| 4,722,100 | A | | 2/1988 | Greer | |
| 4,768,235 | A | * | 9/1988 | Webster | 2/205 |
| 4,887,316 | A | | 12/1989 | Morandini | |
| 4,935,966 | A | | 6/1990 | Hosouchi et al. | |
| 5,101,512 | A | | 4/1992 | Weinstein | |
| 5,287,560 | A | | 2/1994 | Garcia | |

(Continued)

*Primary Examiner*—Amy B Vanatta
(74) *Attorney, Agent, or Firm*—Williamson Intellectual Property Law, LLC; Thomas R. Williamson, III

(57) ABSTRACT

A garment protector suitable for covering the head while trying on wearing apparel to prevent staining or soiling of the wearing apparel from dirt, facial oils, makeup, or the like, wherein the garment protector is comprised of two sheets of tissue paper substantially secured together about their periphery, leaving an opening for insertion of the wearer's head therethrough. Tabs extend downward from the open portion of the periphery, wherein the tabs are removably insertable in the wearer's clothing/undergarments to secure the garment protector in place prior to trying on the wearing apparel.

19 Claims, 2 Drawing Sheets

U.S. PATENT DOCUMENTS 5,713,076 A * 2/1998 Davis ..... 2/4
D394,736 S * 6/1998 Ussery et al. ..... D5/865
5,864,887 A 2/1999 Kozawa
6,694,524 B2 2/2004 Azu
2003/0009815 A1 1/2003 Azu

* cited by examiner

GARMENT PROTECTOR AND METHOD OF USE THEREOF

TECHNICAL FIELD

The present invention relates generally to garment protectors, and more specifically to a double-layer tissue enclosure for covering the head portion of a wearer while the wearer is trying on clothing, whereby the garment protector prevents staining of the clothing by makeup, perspiration, dirt and oils from the wearer's head, neck and upper torso.

BACKGROUND OF THE INVENTION

It is often desirable during the selection of new wearing apparel to observe how the new wearing apparel fits and/or coordinates with the clothing presently being worn. However, to do so requires that a wearer put the new wearing apparel on prior to purchasing same. Accordingly, the new wearing apparel may become soiled and/or stained by the wearer's makeup, perspiration, oils, and/or dirt adhering to the wearer. Since the wearer has not purchased the new wearing apparel and may not do so, it is desirable to have a means to protect the new wearing apparel from such soiling.

In order to prevent such soiling and/or staining, it is desirable to employ a garment protector to cover the exposed head and neck portion of a wearer. Such a garment protector provides a protective layer between the head and neck of the wearer and the wearing apparel being tried on, and further protects the wearing apparel during removal thereof. At the same time, the wearer needs to visually observe his/her appearance, and thus the garment protector is required to be transparent, translucent or have a facility for unimpeded vision therethrough.

Various attempts have been made to provide a measure of protection to wearing apparel to prevent staining/soiling thereof. For instance, some existing garment protectors include temporary covers for a wearer's head and shoulders to protect wearing apparel that is being put on, or removed, from becoming stained or soiled from contact with the wearer's cosmetics, coiffure, and facial oils, or from becoming entangled with the wearer's jewelry. However, such devices lack the ability to adequately protect the new wearing from staining/soiling.

One device teaches a bib extension that lies over clothing to prevent contamination of the front thereof, while other devices require assembly around the wearer's head, often requiring a user-supplied fastening means. Some devices require a fastening means, leaving the user insecure as to whether the fastening means will remain secure and also require additional time in assembly and/or installation. While there are devices that do not require an additional fastening means, often such devices do not cover the head, or cover the entire body, thereby obscuring clothing already in place, and defeating a visual comparison with the new wearing apparel.

Thus, most existing devices lack a convenient integral means for securing the garment protecting device, such as within the wearer's undergarment or other existing clothing. Due to the lack of a convenient means for securing the garment protector to the wearer, existing devices take time to install and/or lack security.

Therefore, it is readily apparent that there is a need for an economical, disposable garment protector that can be conveniently and quickly put on, and which remains securely in place while a wearer is trying on new wearing apparel, wherein the garment protector covers the wearer's head to prevent staining or soiling of the new wearing apparel while same is tried on over clothing presently being worn.

BRIEF SUMMARY OF THE INVENTION

Briefly described, in a preferred embodiment, the present invention overcomes the above-mentioned disadvantages and meets the recognized need for such a garment protector by providing a means suitable for covering the head while trying on wearing apparel, wherein the garment protector comprises a unitary hood formed from two single sheets of tissue paper sealed together. The garment protector has downwardly-extending integral tabs to secure the garment protector in place over clothing being worn while putting on or taking wearing apparel off. Thus, the garment protector prevents staining or soiling of the wearing apparel by dirt, facial oils, makeup, or the like.

According to its major aspects and broadly stated, the present invention in its preferred form is a garment protector comprising two sheets of tissue paper substantially sealed about the peripheral edges thereof, leaving an opening for insertion of the wearer's head therein and therethrough. Two integrally-formed tabs, extend downward from the peripheral edges of the opening, and lay over the wearer's upper chest and upper back, wherein the tabs are preferably inserted or placed through the neck opening of clothing/undergarments currently being worn to secure the garment protector in place.

More specifically, the present invention is a garment protector which can be worn by a user when trying on or placing wearing apparel over the clothing currently being worn by the user. The garment protector has a hood portion that protects the wearing apparel being tried on from the wearer's hair and makeup. The hood portion also protects the wearer's hair from being tousled and the wearer's makeup from being smudged by the wearing apparel being pulled over the wearer's head. The garment protector comprises a front center tab and a rear center tab that extend beyond the lower edge of the hood portion, thereby permitting the tabs to be tucked into the wearer's outer clothing or undergarment. The tabs secure the garment protector within the outer clothing or undergarment, and thus, prevent un-tucking of the garment protector upon removal of wearing apparel being tried on.

The garment protector of the present invention preferably covers the head portion of the wearer, and is transparent, translucent or has a facility for unimpeded vision therethrough, wherein wearing apparel being tried on is protected from staining and/or soiling while the wearing apparel is placed over the wearer's head for ready comparison with clothing currently being worn.

Accordingly, a feature and advantage of the present invention is its ability to prevent contamination of garments from dirt, bodily oils, makeup, or the like.

Another feature and advantage of the present invention is that it can be made from disposable and/or biodegradable materials.

Still another feature and advantage of the present invention is that it can be folded and takes up little space.

Yet another feature and advantage of the present invention is its light weight.

Yet still another feature and advantage of the present invention is ability to permit the wearer to retain visual capacity.

A further feature and advantage of the present invention is its ability to prevent smudging of the wearer's makeup upon placement and/or removal of wearing apparel being tried on over the wearer's head.

These and other features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Selected Alternate Embodiments with reference to the accompanying drawing figures, in which like reference numerals denote similar structure and refer to like elements throughout, and in which.

DETAILED DESCRIPTION OF THE PREFERRED AND SELECTED ALTERNATIVE EMBODIMENTS

In describing the preferred and selected alternate embodiments of the present invention, as illustrated in FIGS. 1-4B, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
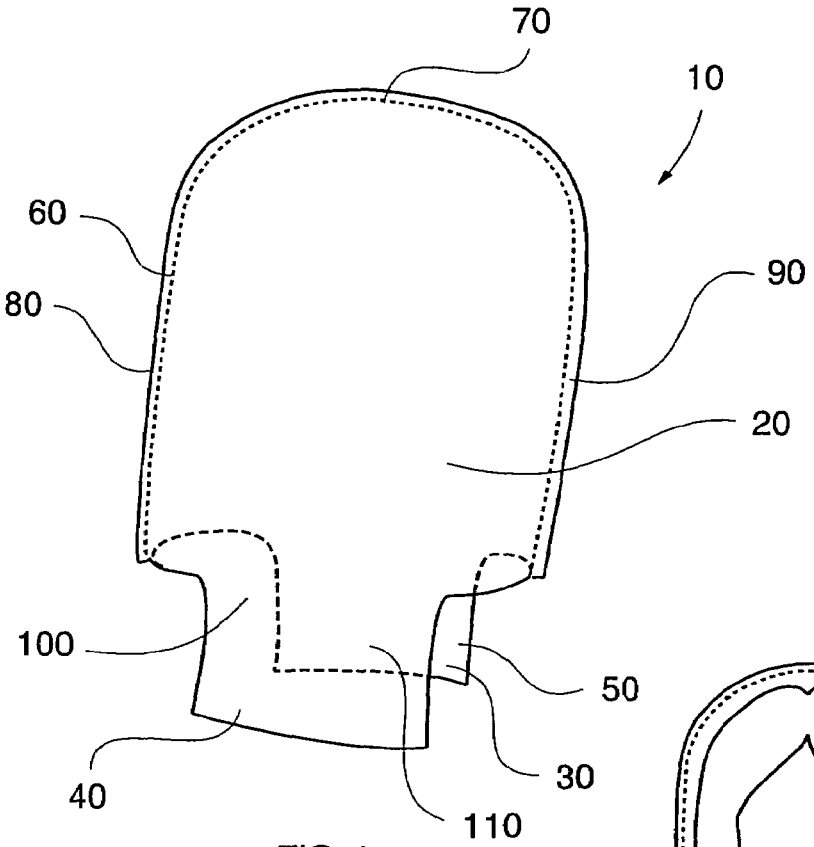
FIG. 1 is a perspective view of a garment protector according to a preferred embodiment of the present invention.
Figure 2:
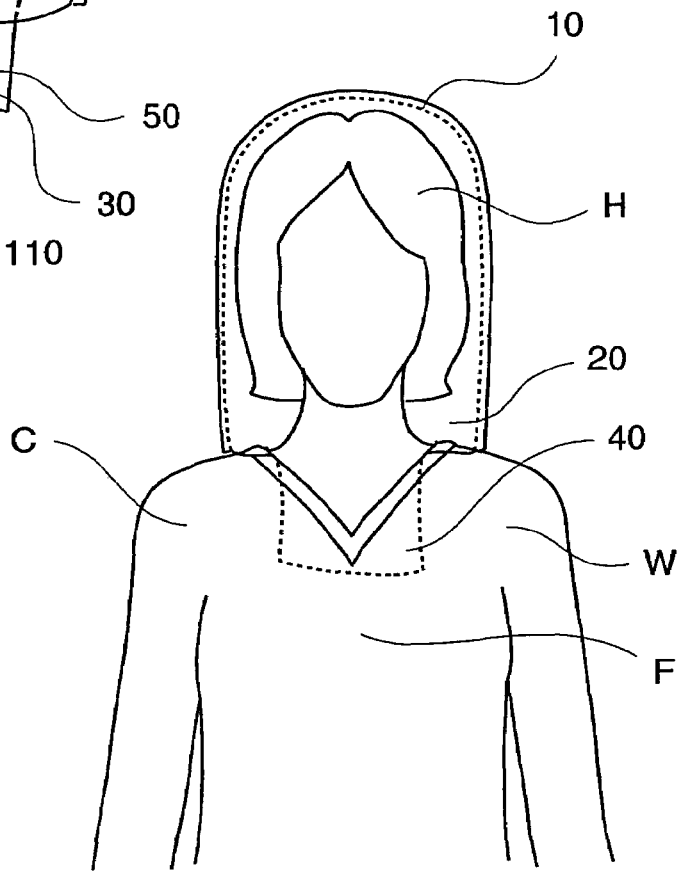
FIG. 2 is a front view of a garment protector according to a preferred embodiment of the present invention, shown in use.
Figure 3:
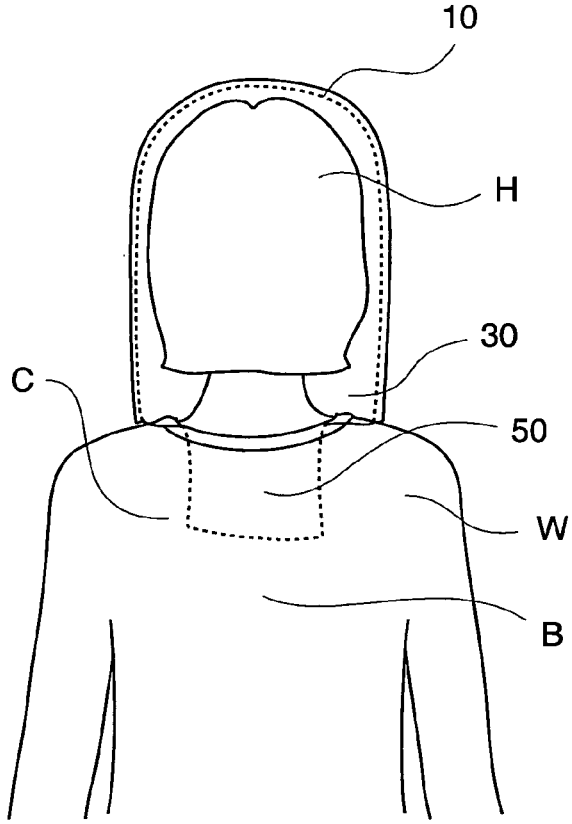
FIG. 3 is a rear view of a garment protector according to a preferred embodiment of the present invention, shown in use.

Referring now to FIGS. 1-3, the present invention in a preferred embodiment is a garment protector 10 preferably comprising first sheet 20 and second sheet 30, wherein first sheet 20 preferably comprises first tab 40, and wherein second sheet 30 preferably comprises second tab 50. First sheet 20 and second sheet 30 preferably comprise a transparent and/or translucent material, such as, for exemplary purposes only, tissue paper. First sheet 20 and second sheet 30 are preferably sealed around upper periphery 60, wherein upper periphery 60 comprises top 70, left side 80 and right side 90, and wherein left side 80 and right side 90 are parallel from proximate the top of wearer's head to wearer's shoulders along head H of wearer W when worn, and wherein sheets 20 and 30 preferably comprise unsealed portion 110. Sheets 20 and 30 form a dome-shaped, or hood-shaped, structure that accommodates head H of wearer W, wherein sheets 20 and 30 are preferably opened at unsealed portion 110, thereby forming opening 100 for insertion of head H thereto.

In use, garment protector 10 is preferably pulled over head H of wearer W, wherein head H is preferably inserted into opening 100. Unsealed portion 110 is preferably pulled down to fully cover head H with garment protector 10. First tab 40 is preferably inserted within clothing C via front region F of neck opening O of clothing C, and second tab 50 is preferably inserted within rear region P of neck opening O of clothing C, wherein first tab 40 and second tab 50 are preferably frictionally-retained within clothing C, thereby securing garment protector 10 on head H of wearer W. Tabs 40, 50 can be coated with or made from, frictional material, such as, for exemplary purposes only, rubber, latex, sponge. Alternately tabs 40, 50 comprise hook-and-loop fasteners or be retained via other fasteners, such as, for exemplary purposes only, pins.

Figure 4A:
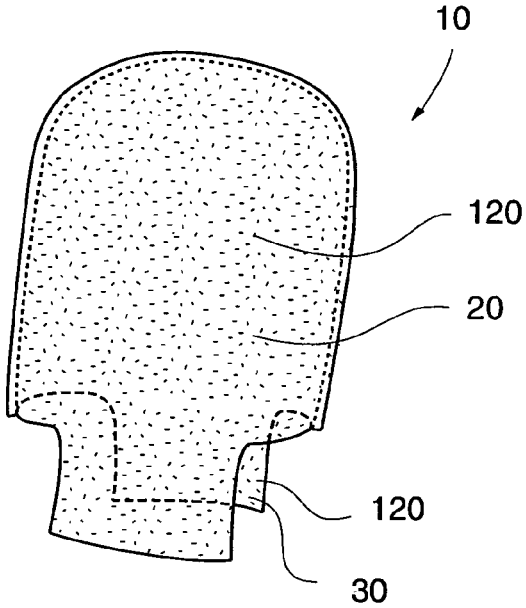
FIG. 4A is a front view of a garment protector according to an alternate embodiment of the present invention; and, FIG. 4B is a front view of a garment protector according to an alternate embodiment of the present invention.

Referring now more specifically to FIG. 4A, illustrated therein is an alternate embodiment of device 10, wherein the alternate embodiment of FIG. 4A is substantially equivalent in form and function to that of the preferred embodiment detailed and illustrated in FIGS. 1-3 except as hereinafter specifically referenced. Specifically, the embodiment of FIG. 4A comprises garment protector 10, wherein first sheet 20 and second sheet 30 comprise perforations 120 therein, wherein perforations 120 facilitate the wearer's breathing when garment protector 10 is placed over head H of wearer W.

Figure 4B:
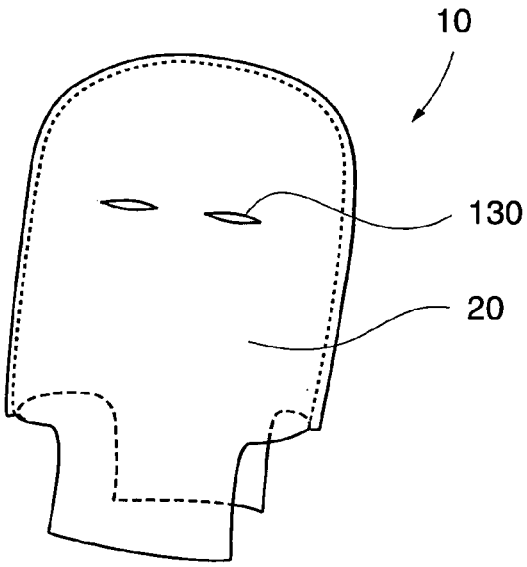

Referring now more specifically to FIG. 4B, illustrated therein is an alternate embodiment of device 10, wherein the alternate embodiment of FIG. 4B is substantially equivalent in form and function to that of the preferred embodiment detailed and illustrated in FIGS. 1-3 except as hereinafter specifically referenced. Specifically, the embodiment of FIG. 4B comprises garment protector 10, wherein first sheet 20 comprises eye slits 130 formed therethrough so as to enable a wearer to see therethrough, while retaining the protection afforded by use of garment protector 10. In this alternate embodiment, garment protector 10 could be comprised of opaque material.

It is envisioned in an alternate embodiment of the present invention that the material utilized to fabricate garment protector 10 would be disposable and/or biodegradable.

It is contemplated in another alternate embodiment particularly suited to preventing disturbance to the hair of wearer W that garment protector 10 could comprise perforations to enable separation and removal of garment protector 10 around head H, without the need to pull garment protector 10 off of head H.

It is contemplated in yet another alternate embodiment of the present invention that garment protector 10 could be an integrally-formed structure, such as by blow-molding or the like.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. A garment protector comprising:

means for covering a wearer's head comprising a first section and a second section, wherein said first section and said second section are secured to one another around the periphery of the wearer's head, and wherein when said garment protector is worn, said first section and said second section each comprise parallel edges along the full length of the wearer's head from proximate the top of the wearer's head to the wearer's shoulders, and anterior and posterior tabs that extend over anterior and posterior portions of the wearer's upper torso, neck and head, without contacting the wearer's shoulders, wherein said tabs secure said garment protector within the wearer's clothing, and wherein said garment protector comprises eye slits, and wherein said eye slits are dimensioned to expose both of the wearer's eyes entirely, and wherein said eye slits provide vision unobstructed by any intervening material.

2. The garment protector of claim 1, wherein said first section and said second section are adapted to receive the head of a wearer inserted thereinto.

3. The garment protector of claim 1, wherein said tabs are carried by said means for covering.

4. The garment protector of claim 3, wherein said tabs extend from an opening formed in said means for covering a wearer's head.

5. The garment protector of claim 3, wherein said anterior tab at least partially extends over an anterior side of the wearer's upper torso, neck and head.

6. The garment protector of claim 5, wherein said posterior tab at least partially extends over a posterior side of the wearer's upper torso, neck and head.

7. The garment protector of claim 2, wherein said first section and said second section together comprise a periphery and wherein said two sections are secured proximate one another around at least a portion of said periphery.

8. The garment protector of claim 1, wherein said garment protector comprises tissue paper.

9. The garment protector of claim 1, wherein said means for covering comprises perforations.

10. The garment protector of claim 2, wherein at least a portion of at least one of said sections is selected from the group consisting of transparent material, translucent material, opaque material, and combinations thereof.

11. The garment protector of claim 1, wherein said tabs are coated with frictional material.

12. A method of protecting clothing comprising the step of:

covering a wearer's head with a garment protector comprising means for covering the wearer's head and anterior and posterior securing tabs, wherein said means for covering the wearer's head further comprises a first section and a second section, and wherein said first section and said second section are secured to one another around the periphery of the wearer's head, and wherein when said garment protector is worn, said first section and said second section each comprise parallel edges along the full length of wearer's head from proximate the top of the wearer's head to the wearer's shoulders, and wherein said garment protector comprises eyes slits, and wherein said eye slits are dimensioned to expose both of wearer's eyes entirely, and wherein said eye slits provide vision unobstructed by any intervening material, and wherein said anterior and posterior securing tabs secure said garment protector within a wearer's clothing without contacting the wearer's shoulders.

13. The method of claim 12, further comprising the step of:

trying on wearing apparel over said garment protector.

14. The method of claim 12, further comprising the step of:

inserting said anterior and posterior securing tabs within the wearer's undergarment, wherein said tabs are disposed between skin of the wearer and said undergarment.

15. The method of claim 12, further comprising the step of:

inserting the wearer's head through an opening in said means for covering.

16. The method of claim 12, wherein said means for covering comprises two sheets of material having peripheries proximate one another.

17. The method of claim 15, wherein said eye slits are dimensioned to expose each of wearer's eyes entirely, and wherein said eye slits provide vision unobstructed by any intervening material.

18. An apparatus for protecting garments comprising:

two sheets of translucent material comprising a periphery and anterior and posterior tab extensions, wherein said two sheets are secured proximate one another around at least a portion of said periphery, and wherein said two sheets are secured to one another around the periphery of the wearer's head, and wherein when said garment protector is worn, said two sheets each comprise parallel edges along the full length of wearer's head from proximate the top of the wearer's head to the wearer's shoulders, and wherein one of said two sheets comprises eye slits, and wherein said eye slits are dimensioned to expose both of wearer's eyes entirely, and wherein said eye slits provide vision unobstructed by any intervening material, and wherein said tab extensions from an unsecured portion of said periphery, and wherein said anterior and posterior tab extensions are dimensioned to substantially cover a chest of a wearer and an upper back of the wearer, respectively, without contacting the wearer's shoulders, and wherein said tabs secure said garment protector within the wearer's clothing.

19. The apparatus of claim 18, wherein said tab extensions are coated with frictional material.

* * * * *